US011111099B2

(12) United States Patent
Terrusi et al.

(10) Patent No.: US 11,111,099 B2
(45) Date of Patent: Sep. 7, 2021

(54) SHEET ACCUMULATION EQUIPMENT

(71) Applicant: Tecnau S.R.L., Ivrea (IT)

(72) Inventors: Francesco Terrusi, Ivrea (IT); Alberto Massucco, Ivrea (IT)

(73) Assignee: Tecnau S.R.L., Ivrea (IT)

( * ) Notice: Subject to any disclaimer, the term of this patent is extended or adjusted under 35 U.S.C. 154(b) by 0 days.

(21) Appl. No.: 16/694,102

(22) Filed: Nov. 25, 2019

(65) Prior Publication Data

US 2020/0165095 A1 May 28, 2020

(30) Foreign Application Priority Data

Nov. 26, 2018 (IT) ..... 102018000010572

(51) Int. Cl.
*B65H 39/10* (2006.01)

(52) U.S. Cl.
CPC ..... *B65H 39/10* (2013.01)

(58) Field of Classification Search
CPC ..... B65H 29/14; B65H 29/145; B65H 31/20; B65H 31/28
USPC ..... 270/58.28; 271/213
See application file for complete search history.

(56) References Cited

U.S. PATENT DOCUMENTS 4,260,148 A 4/1981 Diesch et al.
4,484,736 A 11/1984 Osburg et al.
4,799,663 A 1/1989 Golicz
4,925,180 A * 5/1990 Golicz ..... B65H 33/12 271/198
5,178,379 A 1/1993 Edwards et al.
5,445,368 A 8/1995 Lester et al.
5,484,255 A 1/1996 Lowell
5,775,689 A 7/1998 Moser et al.
7,523,931 B2 * 4/2009 Chiappetta ..... B65H 29/145 271/207
7,976,019 B2 * 7/2011 Masotta ..... B65H 29/18 271/209
2003/0151190 A1 8/2003 Otto et al.
2010/0283197 A1 11/2010 Benjaminson et al.

FOREIGN PATENT DOCUMENTS

DE 9301072 U1 6/1994
FR 1286181 A 3/1962

OTHER PUBLICATIONS

Aug. 7, 2019—App IT 2018000010572—Search Report (IT).
Aug. 7, 2019—App IT 2018000010574—Search Report (IT).

* cited by examiner

*Primary Examiner* — Leslie A Nicholson, III
(74) *Attorney, Agent, or Firm* — Banner & Witcoff, Ltd.

(57) ABSTRACT

An equipment of accumulation of sheets forms a stack of sheets on an accumulation plane by means of driving belts and diverters arranged along the path of the sheets and jump on the accumulation plane. The height of the jump is modified by shifting vertically the accumulation plane with respect to the diverters according to number and/or thickness of the sheets. The diverters can be shifted according to the length of the sheets to be accumulated, while a series of arrest lugs delimits at the rear the area of collection of the sheets and a forwarding mechanism with a pair of output rollers forwards the stack of accumulated sheets when the lugs are released.

11 Claims, 8 Drawing Sheets

SHEET ACCUMULATION EQUIPMENT

RELATED APPLICATION

This application claims priority to Italian Application No. 102018000010572 filed on Nov. 26, 2018 and entitled "Sheet accumulating equipment", the content of which is incorporated herein by reference in its entirety.

FIELD OF THE INVENTION

The present invention relates to a sheet accumulating equipment.

More specifically, the invention relates to a sheet accumulating equipment comprising an accumulation plane for sheets entering along a feeding direction, a plurality of elongated-type driving belts, with respective lower branches positioned in parallel slightly above the accumulation plane and ramp members arranged along the path of the sheets for lifting and engaging the sheets with the lower branches of the belts and in which the driving belts are motorized for dragging the raised sheets and depositing them by jump on the accumulation plane or on sheets in accumulation, in accordance with the introductory part of the main claim.

BACKGROUND OF THE INVENTION

Equipments of this type, for example disclosed by U.S. Pat. No. 7,121,544, are used in mail sending systems, with sheets of limited dimensions (A4), upstream of respective folding devices, for following insertions into envelopes.

In the case of sheets of large dimensions to be accumulated and folded, as required for manufacturing newspapers, brochures or catalogs, accumulating equipments that use driving belts and ramp members present problems. In particular, the entering sheets, after passing over the ramp members, are subject to "flicker" before settling on the sheets already accumulated. These problems are evident for high feed speeds of the sheets and when the height of the jump from the accumulation plane or from the underlying sheets is greater than some mm. For these applications, complex accumulating equipments are used, for example providing accumulation drums with electrostatic action, or multiple platforms suitably motorized. The cost of these equipments is justified only by large productions and large numbers of sheets to be accumulated.

Other problems of the sheet accumulating equipments concern the need of accumulating sheets of different lengths with an accurate alignment of the accumulated sheets preparatory to following folds.

SUMMARY OF THE INVENTION

General object of the present invention is to provide a sheet accumulating equipment of the type including driving belts and ramp members which can be used with sheets of large dimensions and different length at a relatively high speed for subsequent treatments of the accumulated sheets in a reliable and precise manner.

According to this object, the sheet accumulating equipment comprises a suspension group of the accumulation plane and a shifting command mechanism. The suspension assembly is structured to allow a vertical compensation shifting of the accumulation plane with respect to the ramp members so as to modify the height of the jump for the entering sheets, while the shifting command mechanism is provided for shifting the accumulation plane as function of the number and/or thickness of the sheets to be accumulated, while the ramp members are longitudinally shiftable for limiting, by means of the ramp members, the longitudinal extension of a sheet gathering area functionally to the length of the sheets to be accumulated according to the characteristic part of the main claim.

BRIEF DESCRIPTION OF THE DRAWINGS

The characteristics of the invention will become clear from the following description, given purely by way of non-limiting example, with reference to the appended drawings in which.

DETAILED DESCRIPTION OF THE PREFERRED EMBODIMENTS

First Example of Embodiment of the Invention

Figure 1:
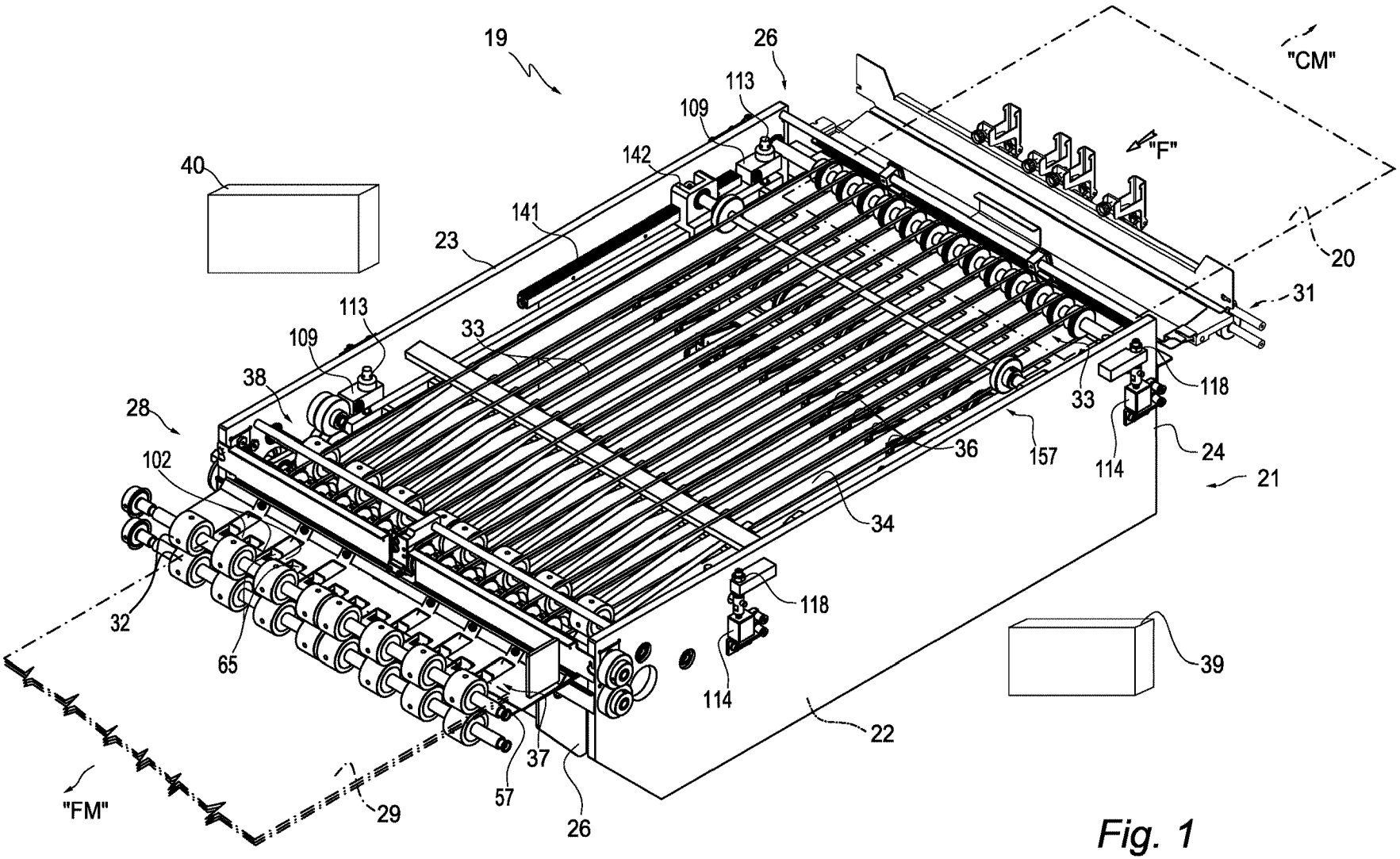
FIG. 1 represents a schematic view of a sheet accumulating equipment according to the invention.
Figure 2:
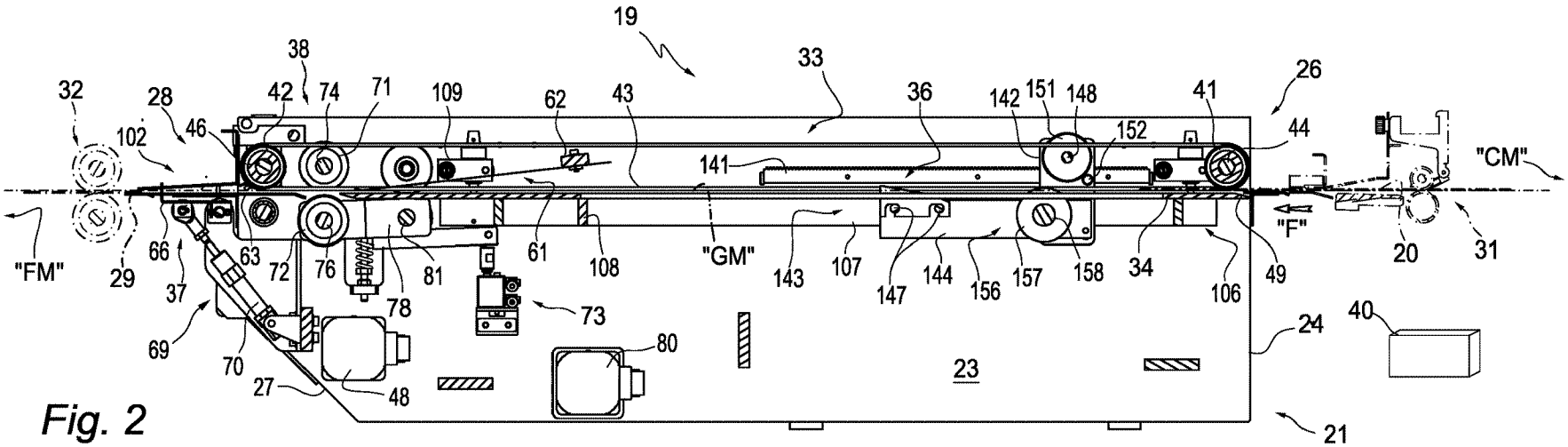
FIG. 2 shows a schematic side section of the equipment of FIG. 1.
Figure 2A:
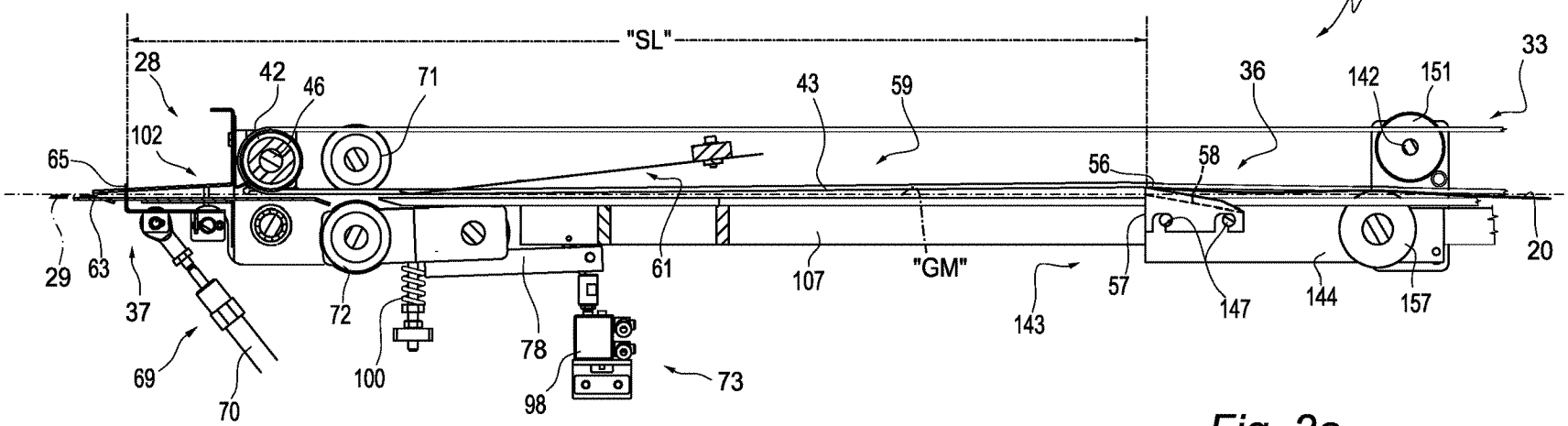
FIG. 2*a* represents parts of FIG. 2, on an enlarged scale.

FIGS. 1, 2 and 2*a* represent an accumulating equipment 19 for sheets 20 in accordance with the invention. The equipment 19 includes a frame 21 with two side walls 22 and 23, a front 24 with an input gate 26 and a back 27 with an output gate 28. Through the input gate 26, the equipment 19 receives the sheets 20 from a feeding apparatus along a feeding direction "F" and, on an accumulating configuration, accumulates the sheets on a stack of accumulated sheets 29. On a forwarding configuration, the equipment 19 forwards the stack of accumulated sheets 29, through the output gate 28 and along the same direction "F", to a user apparatus for subsequent use.

According to a typical application, the sheets 20 come from a paper cutter "CM" with output rollers 31, while the stack of the accumulated sheets 29 is forwarded to an "FM" folder with input rollers 32 for the folding of the stack.

The accumulating equipment 19 comprises a plurality of driving belts 33, an accumulation plane 34, horizontal in use, for the entering and accumulating sheets 20, ramp members or "diverters" 36 individually associated with the driving belts 33, a sheet arrest group 37, a forwarding mechanism 38 for the stack of accumulated sheets 29, a control panel 39 and an electronic control unit 40. The equipment 19 further comprises sensor elements, not shown, arranged along the path of the sheets and connected to the electronic unit 40 for counting the sheets in accumulation and detecting some operating conditions and anomalies.

The driving belts 33 are of the round type (O ring or spaghetti belt), longitudinally elongated and have branches parallel to the feeding direction "F" with axes lying on a geometrical plane perpendicular to the accumulation plane 34. Specifically, the belts 33 are stretched between grooved input pulleys 41 and grooved output pulleys 42 and in which respective lower branches 43 of the belts are arranged a short distance from the plane 34 and define, in the condition of tangency, a geometric plane of movement "GM" for the sheets 20.

The pulleys 41 and 42 are keyed on shafts 44 and 46 which are supported between the side walls 22 and 23 of the frame 21 in proximity of the input gate 26 and, respectively, near the output gate 28. The shaft 44 is idle, while the shaft 46 is connected, through a transmission mechanism with belt and pulley (not shown), to a motor 48 for the driving of the pulleys 42 with movement of the lower branches 43 along the direction F.

Figure 2B:
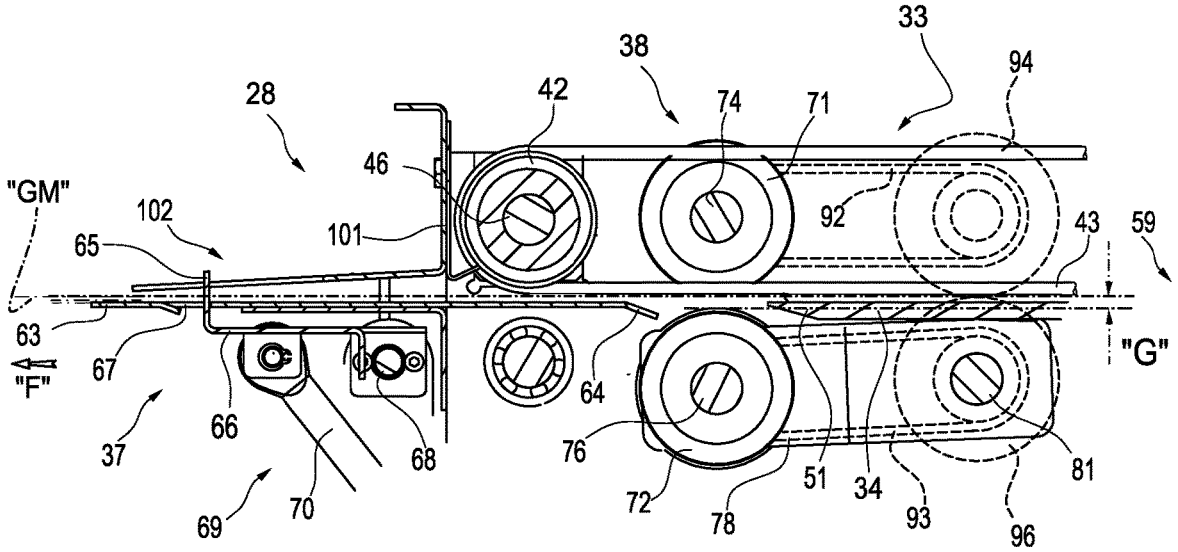
FIG. 2*b* represents other parts of FIG. 2, on an enlarged scale, for a given operating condition.
Figure 4:
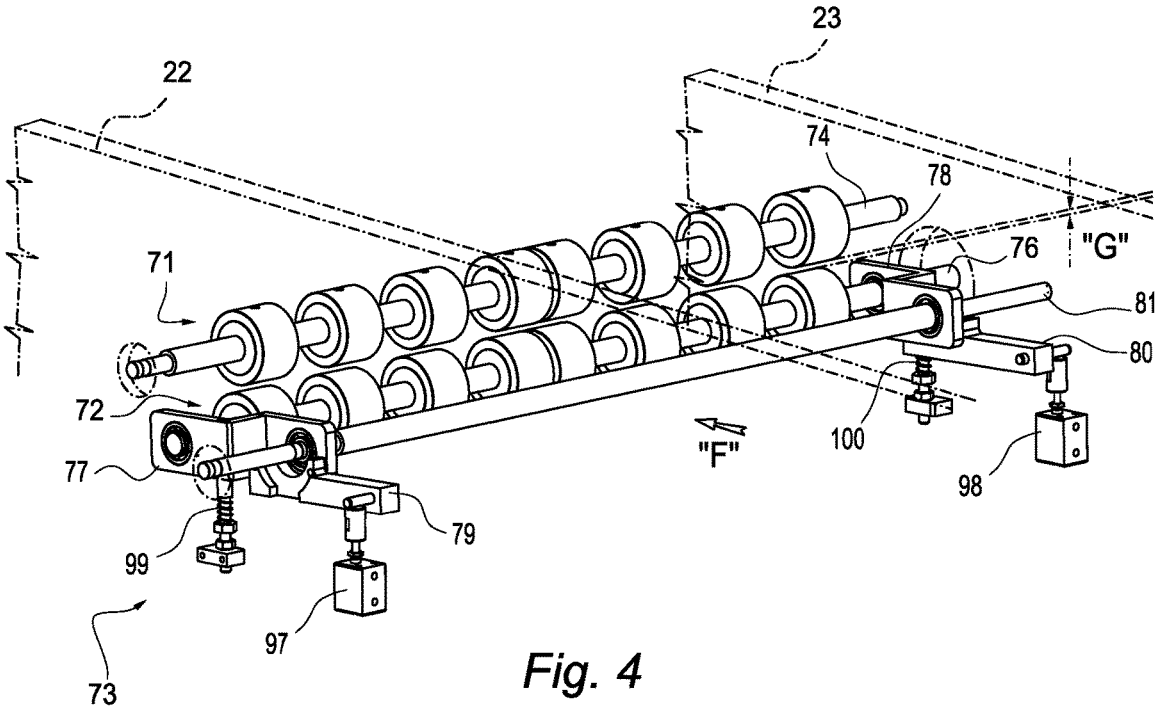
FIG. 4 is a schematic view of other components of FIG. 1.
Figure 6:
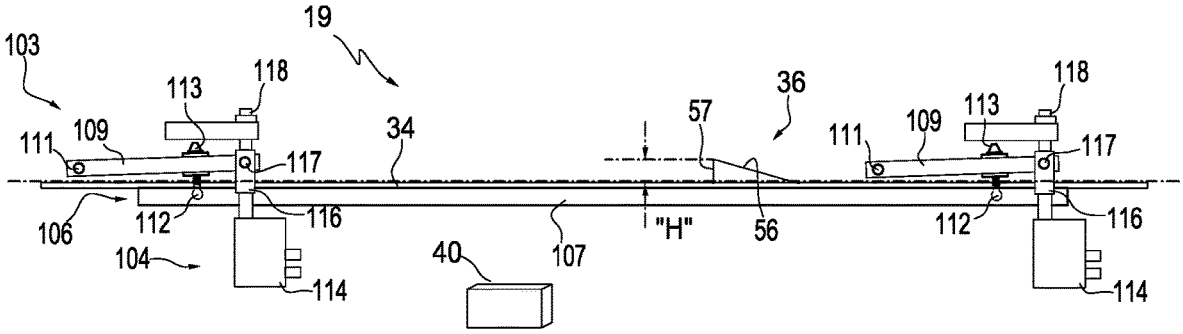
FIG. 6 shows a side diagram of some components of the equipment of FIG. 1 in a given operating condition.

The accumulation plane 34 extends in length between a front edge 49 adjacent to the input gate 26 and a rear edge 51 spaced away from the output gate 28 (FIGS. 2*b*, 4 and 6). The accumulation plane 34 defines longitudinal slots 52, while the ramp members 36 project upwards from the slots 52, above the geometric plane "GM" in an intermediate zone of the plane 34.

The ramp members 36 each have an inclined surface 56 and a step 57 and define a groove 58 in the upper part. At rest, the lower branches 43 of the driving belts 33 are freely received in the grooves 58 of the ramp members and in the condition of tangency with the geometric plane "GM".

According to a known technique, the sheets 20 entering the equipment 19 are pushed by the output rollers of the external feeding apparatus into the space existing between the lower branches 43 of the driving belts 33 and the accumulation plane 34 up to the ramp members 36 with consequent lifting of the leading edges of the sheets. Here, with slight deformation, the sheets are engaged by the branches 43 and dragged along the inclined surfaces 56. The action continues with the passage on the ramp members 36 and the dragging of the sheets below the "GM" plane. It occurs into a collection area 59 (see FIG. 2*a*) downstream of the step 57, along the accumulation plane 34 or on the accumulating sheets. When the trailing edges of the entering sheets leave the ramp members 36, the sheets 20 disengage from the belts 33 and are deposited by jump on the plane 34 or on the accumulating sheets in the collection area 59.

The sheet arrest group 37 operates on the collection area 59 and is switchable between a closed disposition and an open disposition. The arrest group 37 is provided for arresting the accumulating sheets 29 in the closed disposition, and releasing the accumulated sheets 29 in the open disposition.

For a smooth operation of the equipment 19, a series of leaf springs 61 exert a stabilizing action on the accumulating sheets in the collection area 59. In particular, the leaf springs 61 extend longitudinally above the plane 34 with inclination from top to bottom and each have a free end and an end fixed on a crossbar 62. The leaf springs 61 are interposed between the belts 33 for the entire width of the accumulation plane 34, downstream of the ramp members 36 and, in the operating conditions, rest lightly with their free ends on the accumulating sheets on a part of the plane 34 adjacent to the rear edge 51.

Figure 2C:
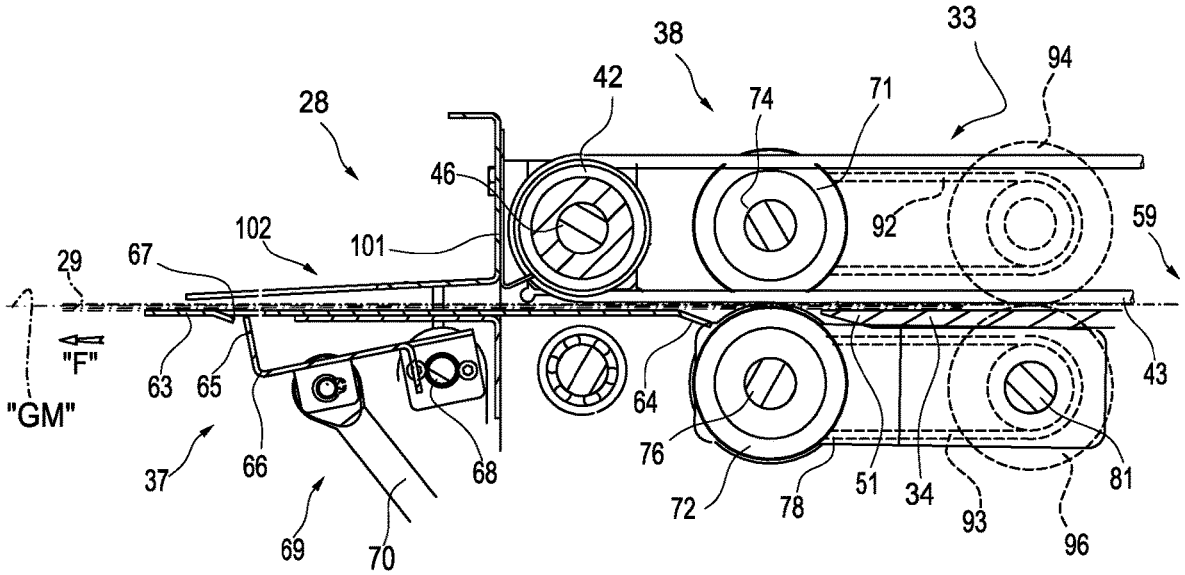
FIG. 2*c* represents the parts of FIG. 2*b* for another operating condition.
Figure 3:
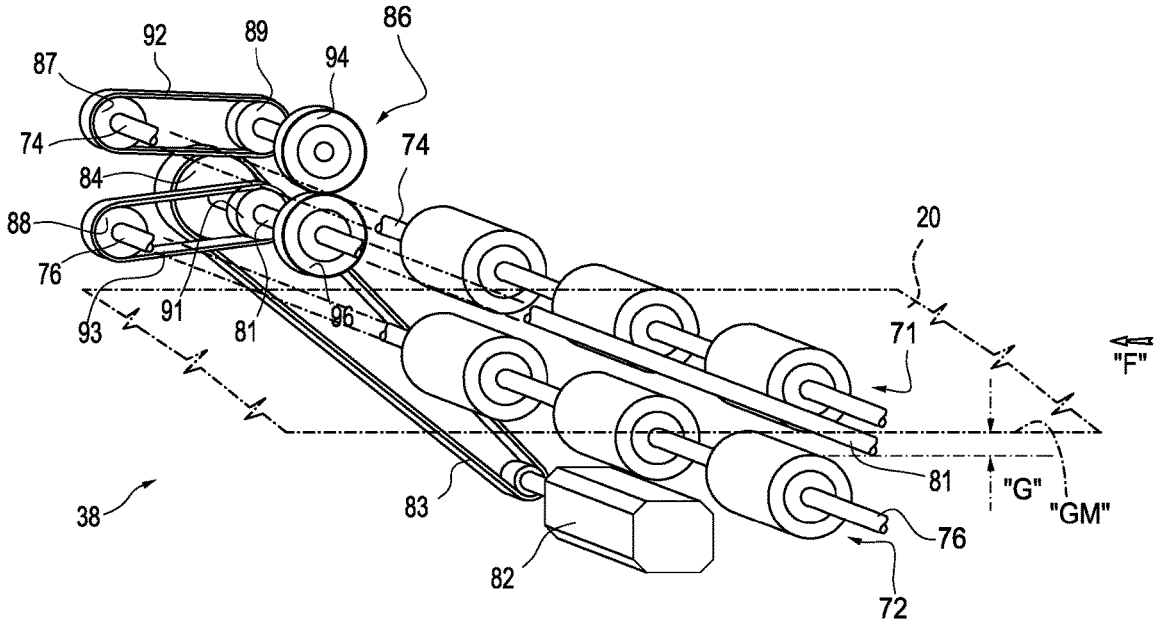
FIG. 3 shows a perspective diagram of some components of the equipment of FIG. 1.

Associated with the accumulation plane 34 is provided a platform 63 (FIGS. 2*b* and 2*c*), which is arranged behind the accumulation plate, slightly below the geometric plane "GM", and completes the collection area 59. The platform 63 crosses the output gate 28 and defines an internal section projecting inwards and an external section projecting outward.

The internal section of the platform 63 has a bevelled front edge 64, which is arranged in front of the edge 51 of the accumulation plane 34 and so as to leave a space of separation with respect to the plane 34. The external section of the platform 63 accommodates the leading edges of the accumulating sheets, while a bank member of the sheet arrest group 37 in the closed disposition of the arrest group operates on the platform 63 for defining rearward the collection area 59 with accurate vertical alignment of the leading edges of the accumulated sheets.

The bank member of the sheet arrest group 37 is constituted, for example, by arrest lugs 65, which, in the closed disposition of the arrest group, are at a distance "SL" (FIG. 2*a*) from the steps 57 of the ramp members, corresponding to the length of the sheets 20 to be accumulated. Therefore, the collection area 59 is delimited at the front by the steps 57 of the ramp members 36 on the plane 34 and, at the rear, by the lugs 65 of the arrest group 37 on the external section of the platform 63.

Specifically, the sheet arrest group 37 is constituted by a lamina 66 with an "L" bend forming the arrest lugs 65, while the external section of the platform 63 has transversal openings 67. The lamina 66 is pivoted on a transversal axis 68 beneath the platform 63 and in which the "L" bend is directed upwards, while the arrest lugs 65 have the possibility of crossing the openings 67 of the platform 63.

The sheet arrest group 37 can be actuated by an arrest control device 69 between the closed disposition (FIG. 2*b*) in which the bank member holds back the accumulating sheets in the collection area 59 and the open disposition in which the bank member (FIG. 2*c*) allows the forwarding of the accumulated sheets 29.

In the closed disposition of the sheet arrest group 37 (FIG. 2*b*), the arrest lugs 65 cross through the openings 67 projecting upwards from the platform 63 and form the rear limit of the collection area 59 as previously described. In the open disposition of the arrest group 37 (FIG. 2*c*), the lugs 65 remain below the platform 63 and leave a free passage along the platform 63 for the forwarding of the accumulated sheets 29 to the external user apparatus.

The arrest control device 69 comprises a cylindrical actuator 70 (FIG. 2) of the pneumatic type, interposed by means of fulcrums at its ends between a bracket formed in an intermediate area of the lamina 66 and a bracket mounted on the rear 27 of the frame 21. On control of the electronic unit 40, the actuator 70 is actuatable between an extended condition and a retracted condition. The actuator 70 positions the bank member for the closed disposition of the group 37 on its extended condition, while positions the bank member for the open disposition of the group 37 on its retracted condition.

The forwarding mechanism 38 includes two series of motorized output rollers 71 and 72 (FIGS. 2, 2*b*, 2*c*, 3 and 4) and a forwarding actuation device 73. The rollers 71 and 72 are arranged transversely to the direction "F" upstream of the arrest lugs 65, in the space between the front edge 64 of the platform 63 and the rear edge 51 of the plane 34, respectively above and below the geometric plane "GM". The forwarding actuation device 73 is provided for determining, upon control of the electronic unit 40, an accumulation arrangement or a forwarding arrangement of the output rollers 71 and 72.

In the accumulation arrangement of the rollers 71 and 72 and the closed disposition (FIG. 2*b*) of the arrest group 37, a space "G" is formed between the rollers 71 and 72 to allow the driving belts 33 to accumulate the sheets 20 in the collection area 59. In the forwarding arrangement, and the open disposition (FIG. 2*c*) of the group 37, the output rollers 71 and 72 press the accumulated sheets 29 for their extraction from the collection area 59 and forwarding them to the user apparatus along the direction "F". It occurs together with a synchronous rotation and in the opposite direction of the same rollers 71 and 72.

The upper output rollers 71 (FIG. 4) are keyed on a shaft 74 rotatably supported and transversely fixed between the side walls 22 and 23 of the frame 21. The lower output rollers 72 are keyed on a shaft 76 with the possibility of transversal shifting with respect to the shaft 74. To this end, the shaft 76 is rotatably supported between the extremities of two arms 77 and 78 with projections 79 and 80. The arms 77 and 78 are pivoted, inside the frame 21 and near the side walls 22 and 23, around a shaft 81 which is rotatably and transversely fixed between the side walls 22 and 23, while the forwarding actuation device 73 operates on the projections 79 and 80 which protrude from a section of the arms 77 and 78 opposite to the extremity shaft 76 with respect to the shaft 81.

The motorization of the output rollers 71 and 72 is carried out by a motor 82 (FIG. 3) through a transmission chain including a toothed belt 83, a primary pulley 84, a distributing group 86 and two driven pulleys 87 and 88 keyed on the shafts 74 and 76. In summary, the primary pulley 84 is keyed to an extremity of the shaft 76 and the distributing group 86 comprises two driving pulleys 89 and 91 and two belts 92 and 93 for the driven pulleys 87 and 88 and two transmission gear wheels 94 and 96 in mutual engagement. The gear wheel 94 is rigidly coupled with the driving pulley 89 while the gear wheel 96 is keyed on the shaft 81. In this way, the motor 82 can impart a synchronous motion and in the opposite direction to the output rollers 71 and 72 for the forwarding of the stack of accumulated sheets 29.

The forwarding actuation device 73 (FIG. 4) comprises two pneumatic actuators 97 and 98 actuatable between an extended condition and a retracted condition and contrasting springs 99 and 100. The actuators 97 and 98 operate on the extremities of the projections 79 and 80, while the springs 99 and 100 operate on intermediate sections of the arms 77 and 78.

In the accumulation arrangement of the rollers 71 and 72, the actuators 97 and 98 are in the extended condition with pressure engagement on the projections 79 and 80 of the arms 77 and 78 against the action of the contrasting springs 99 and 100. The shaft 76 is moved away from the shaft 74 and determines the space "G" between the output rollers 71 and 72 for the accumulation of the sheets 20 entering the collection area 59.

In the forwarding arrangement of the rollers 71 and 72, the actuators 97 and 98 are in the retracted condition, disengaged from the projections 79 and 80, while the contrast springs 99 and 100 push the shaft 76 towards the shaft 74. In this way, the rollers 72 engage under pressure the accumulated sheets 29 against the rollers 71 (FIG. 2*c*) in the space between the platform 63 and the plane 34 for the forward of the stack of sheets 29 as previously described.

The sheet accumulating equipment 19 also comprises a lamina 101 (FIGS. 1, 2 and 2*b*), mounted transversely above the output gate 28 and with an "L" shaped bent protruding outwards and forming a series of longitudinal lugs 102.

The longitudinal lugs 102 are interposed between the arrest lugs 65, are inclined downwards and have respective free ends arranged in front of and at a short distance from the outer section of the platform 63. Thus, the longitudinal lugs 102 define, in the forwarding configuration of the equipment 19, an upper guide with stabilization function for the stack of sheets 29 moving on the platform 63.

For a reliable accumulation of the sheets 20 and high operating speed, the height of the step 57 between the top of the inclined surface 56 of the ramp members 36 (FIGS. 2*a* and 6) and the accumulation plane 34, represented with "H", must be included between a minimum value and a maximum value in a rather small range of variation. An insufficient jump would cause stumbling on the underlying sheets and curling up of the entering sheet. An excessive jump would cause the formation of air pockets between the accumulated sheets, creating wrinkles in the stack of sheets forwarded to the user equipment, specifically in the folding executed by the "FM" folder.

In the accumulation arrangement of the rollers 71 and 72, the height of the jump for the sheets 20 from the ramp members 36 with respect to the underlying sheets is progressively reduced depending on the number of sheets already accumulated. The operative limits regarding the minimum value of the jump for the condition of complete accumulation of the sheets and the height "H" for the condition of empty status of the collection area determine the maximum number "N" of the sheets to be accumulated.

The minimum and maximum values of the jumps acceptable by the ramp members 36 depend significantly on the dimensions and weight of the entering sheets 20 and on the operating speed of the equipment 19. For sheets larger than A3, average weight between 50 gr/m$^2$ and 80 gr/m$^2$ and speed of the sheets over 100 m/min, a value of the height "H" considered adequate is about 7 to 10 mm. with a reliable accumulation of 2 to 10 entering sheets 20.

Figure 5:
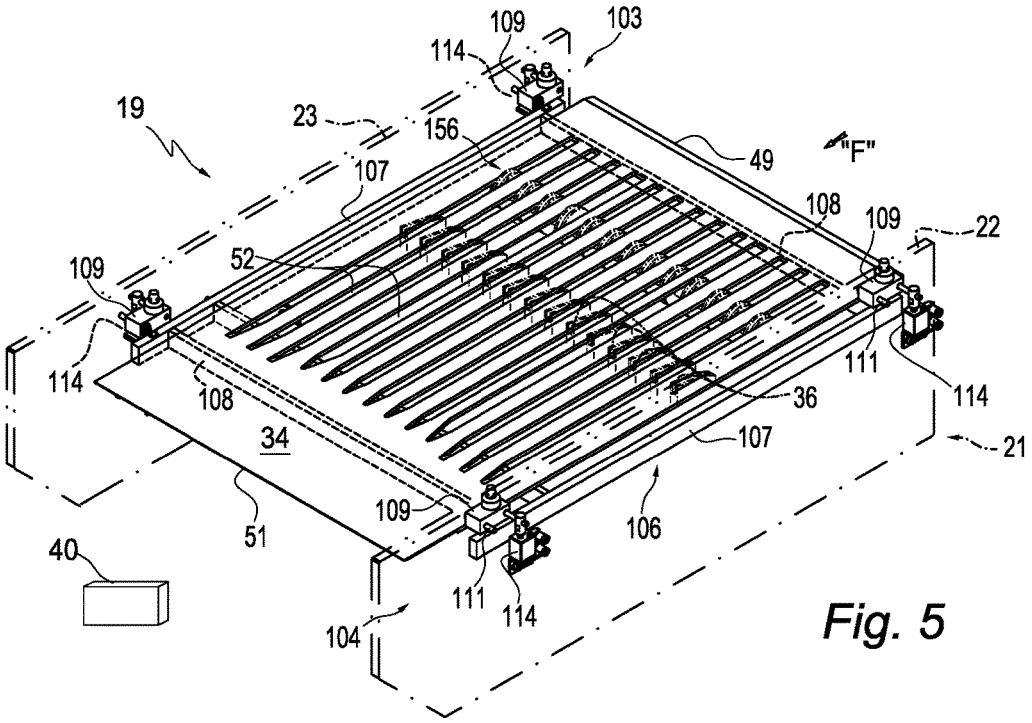
FIG. 5 is a schematic view of further components of the equipment of FIG. 1.

According to the invention, in order to consistently increase the maximum number of accumulable sheets, the equipment 19 comprises a suspension group 103 and a shifting command mechanism 104 for the accumulation plane 34. The suspension group 103 allows a vertical compensation shifting of the accumulation plane 34 (FIGS. 5 and 6) with respect to the ramp members 36 during the accumulation configuration of the equipment 19, while the shifting command mechanism 104 is actuatable, on control of the electronic unit 40, for effecting a shifting compensation of the plane 34 according to the number of the accumulated sheets 20.

For ensuring a regular accumulation of sheets also of large dimensions, the accumulation plane 34 has a leveled upper surface and a rigid structure. For example, the plane 34 consists of about a 4-6 mm thick plate of steel or aluminium 50 cm wide and 75 cm long and in which the longitudinal slots 52 are obtained by notching of the plate.

The plane 34 is supported by a plane frame 106 with longitudinal beams 107 and cross bars 108. The longitudinal beams 107 are arranged inside the frame 21, adjacent to the side walls 22 and 23, while the accumulation plane 34 is fixed on the cross bars 108 and so as to leave a free space between its lateral edges and the longitudinal beams 107.

In alternative, the plane 34 can be formed by a series of elongated bars, fixed to the cross bars 108 of the frame 106 and spaced apart from one another so as to define the longitudinal slots 52.

The suspension group 103 is of an articulated quadrilateral type, in which the plane 34 is maintained horizontal during its vertical movement. Specifically, the suspension group 103 comprises four lever arms 109 pivoted, by means of pins 111 fixed to the side walls 22 and 23, internally to the frame 21 and in a condition of adjacency with the side walls 22 and 23. The lever arms 109 are connected to the plate frame 106 by means of spherical joints 112 on the longitudinal beams 107 and by means of manual adjustment groups 113 of screw and knob type. The adjustment groups 113 are interposed between an intermediate section of the lever arms 109 and the joints 112 and can be manually operated for positioning the plane 34 in a reference position with respect to the arms 109.

The lever arms 109 have a substantial horizontal arrangement and the accumulation plane 34 is moved vertically by tilting of a same amount the arms 109. In the field of application of the equipment 19, the compensation shifting of the plane 34 is rather limited. The lever arms 109 are inclined slightly around the horizontal and cause a very limited component of longitudinal shifting on the accumulation plane 34.

In the first embodiment of the invention, the accumulation equipment 19 (FIGS. 1, 2, 5, 6 and 6*a*) is provided for increasing with high reliability, by a given amount, the maximum number "N" of sheets to be accumulated.

For example, for doubling the number of accumulable sheets, with ramp members 36 of height "H" with respect to the plane 34, after the accumulation of "N" sheets and minimum jump, the plane 34 is lowered by a value "Δc" (See FIG. 6*a*) corresponding to the thickness of the sheets already accumulated. The height "H" is thus restored, to the maximum acceptable jump for the accumulation in optimal conditions, starting from the "N" sheets 20 already accumulated.

Figure 6A:
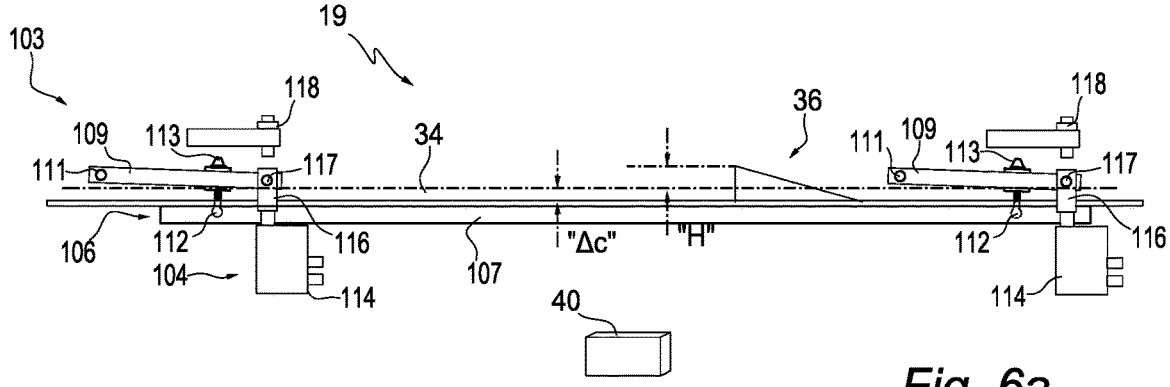
FIG. 6*a* represents the side diagram of the components of FIG. 6 in another operating condition.

The shifting command mechanism 104 comprises four pneumatic actuators 114 which operate on the lever arms 109 and can be switched between an extended condition of FIG. 6 and a contracted condition of FIG. 6*a* for lowering the accumulation plane 34, starting from its reference positions. The electronic control unit 40 counts the accumulated sheets 20 and activates the switching for the contracted condition and the "Δc" lowering of the plane 34 when "N" accumulated sheets have been reached to proceed with the accumulation up to other "N" sheets.

The pneumatic actuators 114 are fixed on the outside of the sidewalls 22 and 23 and have respective actuating cylinders 116 connected via pins 117 with one end of the lever arms 109 through corresponding openings of the side walls 22 or 23. Stroke adjustment screws 118 define the strokes of the actuating cylinders 116, between the extended condition and the contracted condition.

The adjustment screws 118 can be operated manually for determining the displacement "Δc" of the accumulation plane 34. In turn, for positioning the plane 34 at its reference position, the manual adjustment group 113 is operable in the extended condition of the pneumatic actuators 114.

Second Example of Embodiment of the Invention

Figure 7:
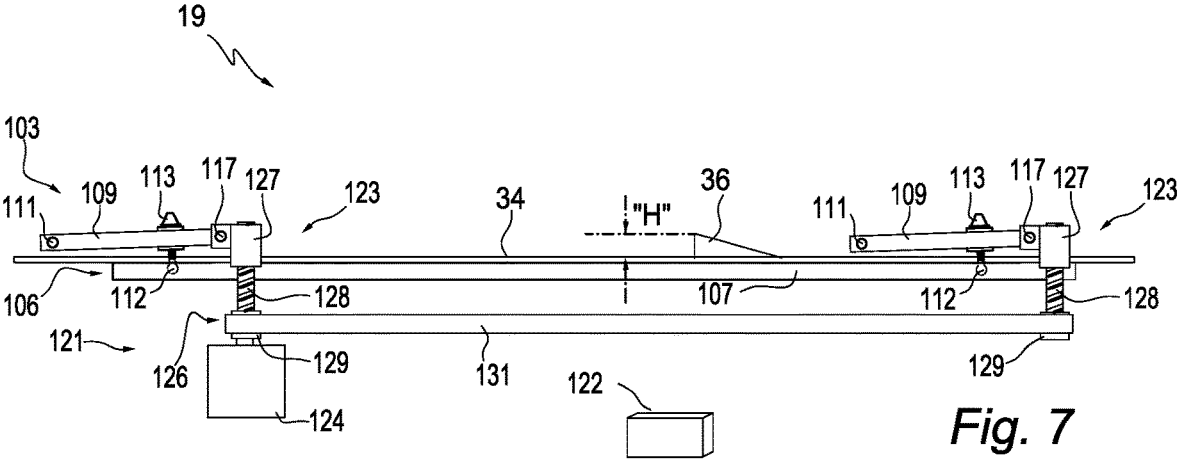
FIG. 7 shows a side diagram of some components of the accumulating equipment in accordance with the invention, according to another embodiment and for a given operating condition.
Figure 7A:
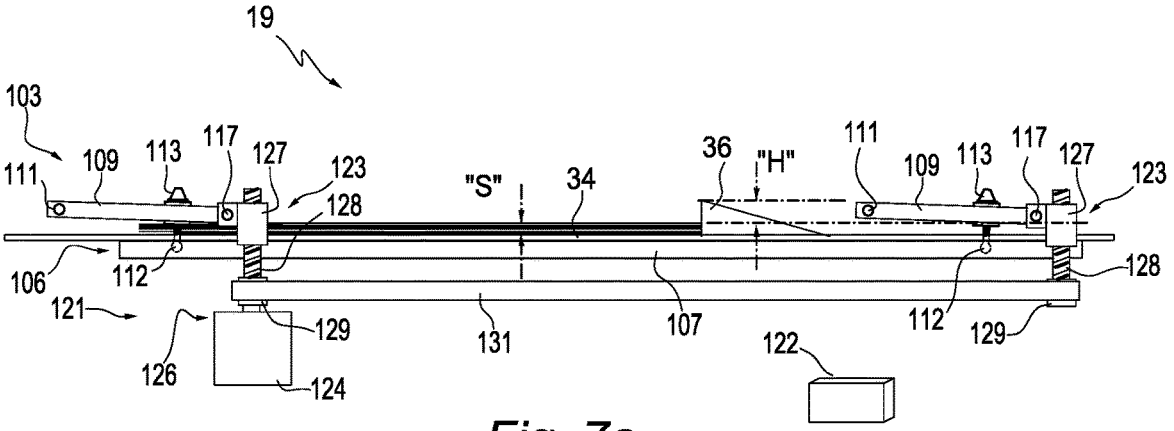
FIG. 7*a* is the side diagram of FIG. 7 for another operating condition.
Figure 8:
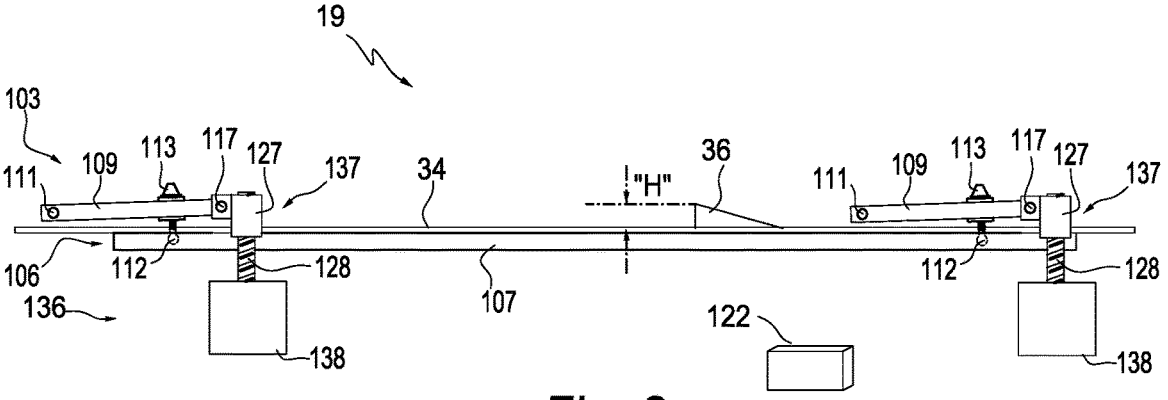
FIG. 8 shows a side diagram of some components of the equipment according to a variant of the embodiment of FIG. 7.

In a second embodiment of the invention, the equipment 19 (FIGS. 7, 7*a* and 8) is carried out in such a way as to keep constant, in the accumulation configuration, the height of the jump of the sheets 20 from the ramp members 36 independently of the number of accumulated sheets. In this case, a shift command mechanism, indicated with 121, upon control of an electronic unit 122, lowers the plane 34 in a progressive manner depending on the number of the previously accumulated sheets.

The shift command mechanism 121 comprises four motion converters 123 operating on the lever arms 109, a servomotor 124 and a transmission group 126 between the converters 123 and the servomotor 124.

For example, the motion converters 123 each comprise a nut screw 127 and an endless screw 128. The nut screw 127 is for controlling a respective lever arm 109 while the endless screw 128 is axially fixed and engaged by the nut screw 127 The servomotor 124 operates directly on the endless screw of one of the motion converters 122 and, via the transmission group 126, acts on the endless screws of the other motion converters. The transmission unit 126 comprises four synchronous toothed pulleys 129 in rotation with the endless screw 128 and a toothed belt 131 in engagement with the pulleys 129. In this way, the motion from the toothed pulley driven by the servomotor 124 is transmitted to the endless screws of the other converters for a joint control of the four lever arms 109.

The electronic control unit 122 counts the accumulating sheets 20 and incrementally activates the servomotor 124 by rotating the endless screw 128 so as to tilt the lever arms 109 downwards. The accumulation plane 34 is thus lowered to keep the height "H" substantially constant, regardless of the thickness "S" (FIG. 7*a*) of the accumulated sheets.

The incremental shift of the plane 34 can be equal to the thickness of a single sheet 20 but, alternatively, the electronic unit 122 can activate the servomotor 124 after having counted a predetermined number of pre-accumulated sheets for a lowering of compensation of the plane 34 equal to the overall thickness of the counted sheets.

In a variant of the second embodiment of the invention, the shift command mechanism indicated with 136 (FIG. 8) comprises four motion converters 137, which operate on the lever arms 109 by means of the nut screws 127 and endless screw 128 of the converters 122. In this variant, four servomotors 138 are used, which operate synchronously and act directly on the endless screws 128. The lever arms 109 are inclined similarly to the inclinations that can be performed by the servomotor 124 and the transmission group 126 for a similar lowering of compensation of the accumulation plane 34.

The transport of the sheets by means of the driving belts 33 and the ramp members 36, of adequate number, ensures an accumulation, without misalignment, of sheets of different width, in particular but not in a limiting way, newspaper sheets to be folded by the following user apparatus.

According to another feature of the invention, the equipment 19 (FIGS. 1, 9 and 10) is designed for accumulating entering sheets 20 of different longitudinal dimensions. For this purpose, the ramp members 36 is mounted on a support carriage 143, which can be shifted longitudinally with respect to the sheet arrest group 37 for changing the length of the collection area 59 according to the length of the sheets to be accumulated.

Figure 9:
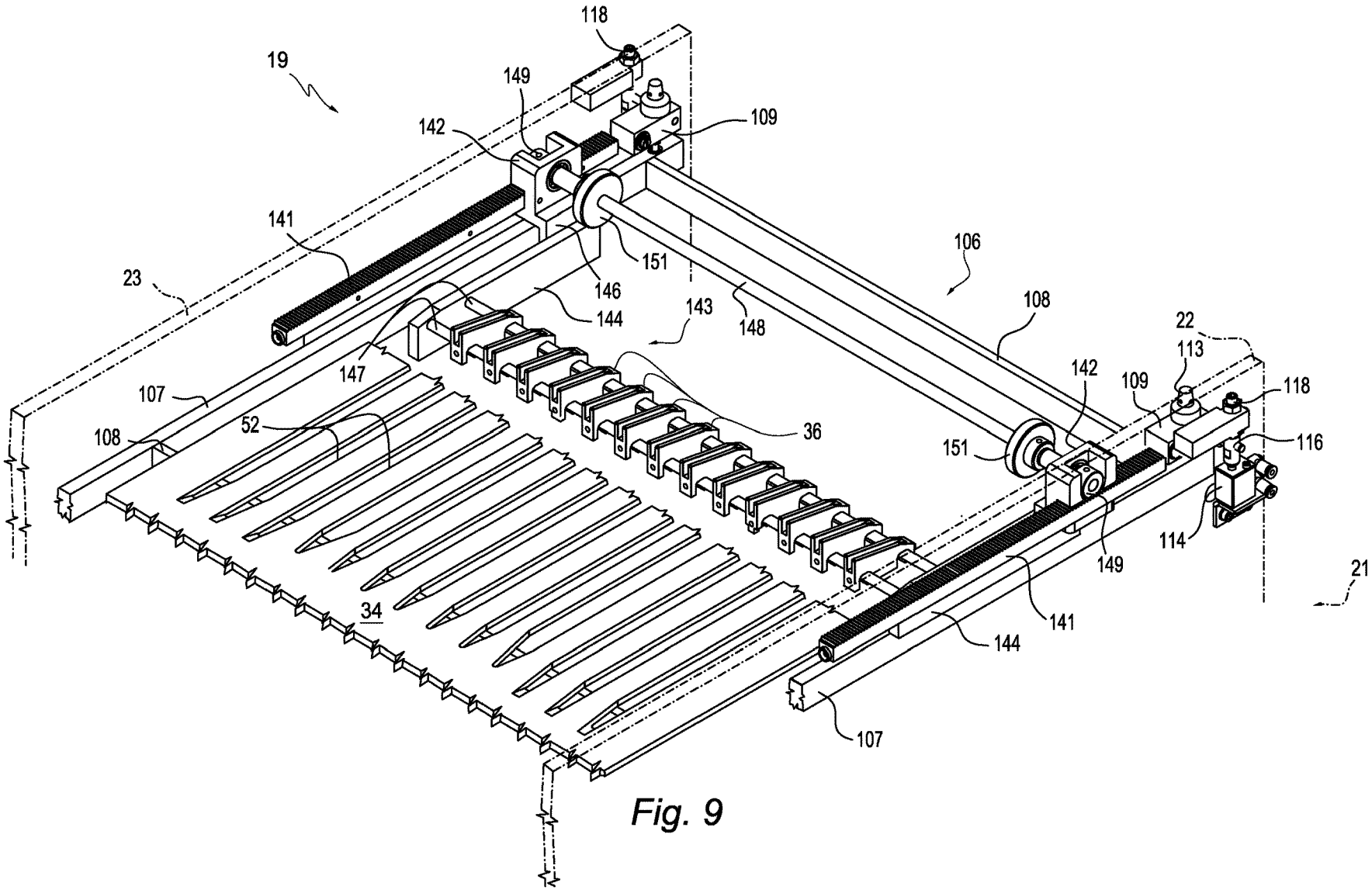
FIG. 9 is a schematic view of further components of the equipment of FIG. 1.
Figure 10:
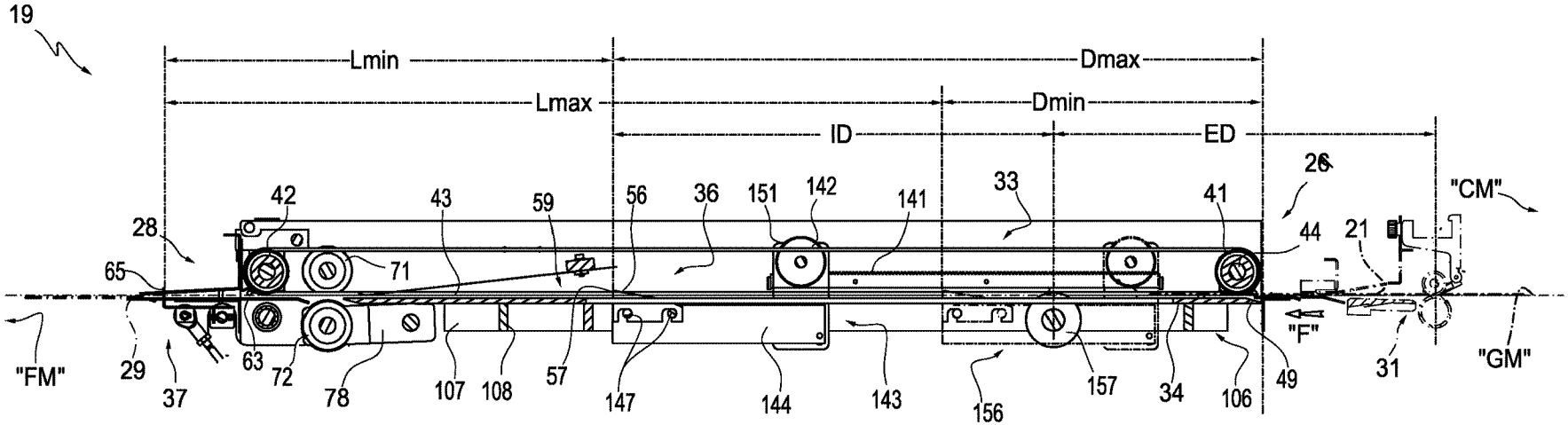
FIG. 10 represents a schematic side section of the equipment of FIG. 1 with evidence of some functional characteristics.

With reference to FIG. 9, for the shifting of the carriage 143, the equipment 19 comprises two racks 141 and two slides 142 sliding on the racks 141, which are connected with the carriage 143. The racks 141 are fixed on the side walls 22 and 23, inside the frame 21, above the longitudinal beams 107 of the frame 106. The carriage 143 comprises two lateral blocks 144 arranged below the accumulation plane 34 and supported by the slides 142 through respective vertical tongues 146 passing through the space between the side edges of the plane 34 and the longitudinal beams 107 of the frame 106. The blocks 144 are interconnected by two transversal bars 147, side by side, parallel to the plane 34. The ramp members 36 are fixed on the bars 147, are in alignment with the longitudinal slots 52 and protruding from the slots 52 of the plane 34, as above reported.

The slides 142 rotationally support a shaft 148 on which two pinions 149 and two handwheels 151 are keyed. The pinions 149 are in meshing with the racks 141. The handwheels 151 can be operated manually for rotating the shaft 148, with shifting of the slides 142 with respect to the racks 141 and shifting of the tongues 146 in the space between the plane 34 and the longitudinal beams 107. Via the carriage 143, the ramp members 36 can thus be moved along the longitudinal slots 52 as front demarcation position of the collection area 59. Two respective locking members with a knob 152 (see FIG. 2) can be manually operated for locking the slides 142 on the racks 141 in the selected positions.

Figure 11:
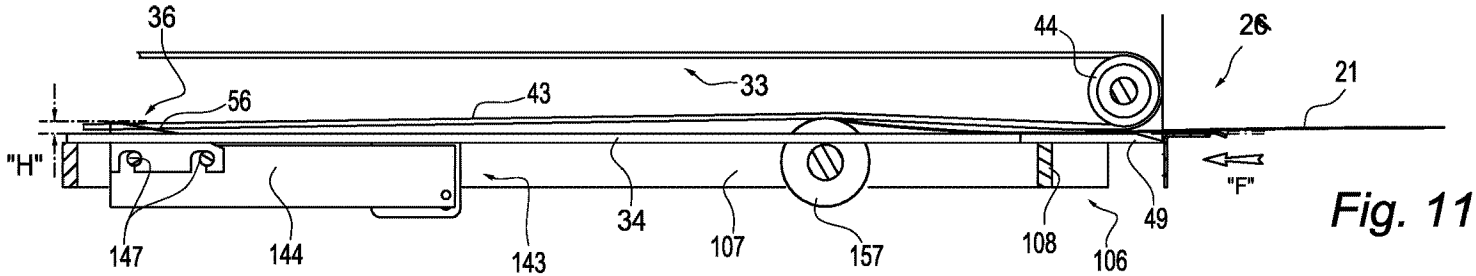
FIG. 11 shows, on an enlarged scale, details of FIG. 10 in a given operating condition.
Figure 11A:
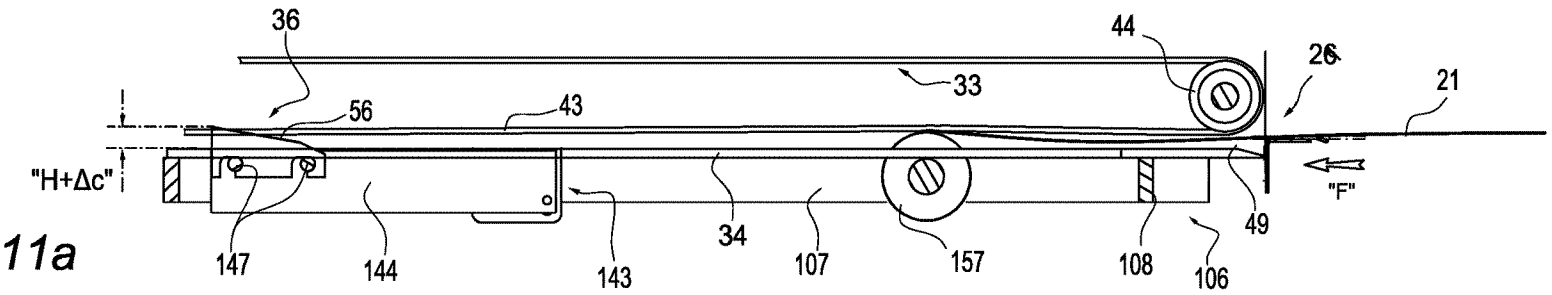
FIG. 11*a* represents the details of FIG. 11 in another operating condition.

As already mentioned, the sheets 20 entering from the input gate 26 are pushed by the external power supply equipment, for example the cutter "CM", along the direction "F". The driving belts 33 (FIG. 11) overcome this action when the leading edges of the entering sheets reach the ramp members 36 and, with the raising, are engaged by the belts 33.

Moreover, the movement by the feeding apparatus is lost when the trailing edges of the sheets 20 disengage from the feeding apparatus. This implies that the minimum length of the accumulated sheets must be greater than the distance between the release area of the feeding apparatus, for example that of the output rollers 31 for the cutter "CM", and the current position of the ramp members 36.

The ramp members 36 (FIGS. 2*a* and 10), with their longitudinal position, in addition to determine the front limit of the collecting area 59, determine the engagement position of the sheet 20 with the belts 33. In detail, the position of the ramp members 36 set for a collection area 59 has a length variable between a minimum value "Lmin" and a maximum value "Lmax", which correspond to the variable distances of the top of the inclined surfaces 56 from the input gate 26 between a maximum value "Dmax" and a minimum value "Dmin". Therefore, the shorter sheets are collected in area 59 of length "Lmin", with engagement distance associated to "Dmax", while the longer sheets are collected in area 59 of length "Lmax", with engagement distance associated to "Dmin".

For reliably accumulating the longer sheets 20, the distance "Lmax"+"Dmin" between the input gate 26 and the arrest lugs 65 is high, but the consequent distance "Dmax" associated with the shorter sheets of length "Lmin" is also high. This distance "Dmax" could be greater than that required for the shorter sheets to ensure the engagement of the leading edges with the ramp members 36 before leaving the external power supply. The shorter sheets would not enter the equipment 19, with tangling of the sheets coming out of the feeding apparatus.

Conveniently, in accordance with the invention, the sheet accumulating equipment 19 comprises lifting members 156 in an area close to the input gate 26. The lifting members 156 are provided for cooperating with the driving belts 33 to begin engagement with the entering sheets and dragging the sheets before the entering sheets reach the ramp members 36 and independently of the position of the same members 36.

According to a non-limiting example, the lifting members 156 (FIGS. 2, 5, and 10) are formed by intermediate grooved wheels 157, arranged near the front edge 49 of the accumulation plane 34 and individually associated with the belts 33. Specifically, the wheels 157 have an upper sector projecting from the slots 52 and a groove which, in the protruding sector, freely accommodates a corresponding portion of the lower branches 43 of the belts 33.

The grooved wheels 157 are keyed on a fixed shaft 158 supported below the accumulation plane 34 by a pair of brackets which are in turn fixed to the lower surface of the plane 34.

The protruding sectors of the grooved wheels 157 are arranged on the path of the sheets 20 entering along the plane 34 and their distance, indicated by "ED", from the moving elements of the feeding apparatus, for example the output rollers 31, must be less than the length of the shorter sheets. In this case, the shorter entering sheets engage the grooved wheels 157 and are raised towards the belts 33 before being released by the output rollers 31 of the feeding apparatus.

The distance "ID" between the protruding sectors of the wheels 157 and the ramp members 36 in the position "Dmax" must also be less than the length of the shorter sheets, for an engagement of the driving belts 33 from the wheels 157 up to the ramp members 36. Thus, the smaller of the distances "ED" and "ID" determines the minimum length of the sheets 20 that can be accumulated by the equipment 19.

In a typical application, the sheet accumulating equipment 19 can accumulate 2-30 sheets, in particular newspapers. The sheets 20 have a width of 20-50 cm and a length of 20-65 cm with a height of jump "H" of 7-10 mm between the top of the inclined surface 56 and the movement plane "GM" and one compensation shift "Δc" of about 2-3 mm for the accumulation plane 34.

With the variant of the second embodiment of the invention, the number of sheets to be accumulated can be considerably increased.

Naturally, the principle of the invention remaining the same, the embodiments and the details of construction of the sheet accumulating equipment may be widely varied with respect to what has been described and illustrated, by way of non-limiting example, without by this departing from the ambit of the present invention.

As a bank member of the sheet arrest group 37, in alternative to the arrest lugs 65, a transversal bar can be provided, in contact with the platform 63 for stopping the sheets in the closed disposition of the group 37 and spaced away from the platform for the passage of the sheets 29 in the open disposition of the group 37.

With suitable modifications, and when an accurate alignment of the accumulated sheets is not required, the bank member of the arrest group 37 can be replaced by the output rollers 71 and 72 of the accumulating equipment 19, or by the pair of rollers input 32 of the external utilization apparatus and which respectively forward the accumulated sheets and introduce the stack of sheets 29. The input rollers 32 will be modified so as to allow, according to known techniques, a spacing and a pressure adjustment to take into account the thickness of the accumulated sheets 29.

In the case of arrest by means of the output rollers 71 and 72, for the accumulation configuration of the equipment 19, the rollers 71 and 72 are in contact each the other and arrest the leading edges of the sheets 20. For the forwarding configuration, the output rollers 71 and 72 engage the stack of accumulated sheets 29 and are driven for forwarding the stack to the user apparatus.

In the case of arrest by the input rollers 32 of the output external apparatus, during the accumulation configuration of the equipment 9, the output rollers 71 and 72 are open while the input rollers 32 are in contact each the other and arrest the leading edges of the sheets 20. For the forwarding configuration, both the output rollers 71 and 72 and the input rollers 32 engage the stack of accumulated sheets 29 and are put in motion for the dragging of the stack toward the user apparatus.

Instead of the articulated quadrilateral structure, the suspension group of the accumulation plane 34 can comprise vertically sliding slides. The compensation shift of the accumulation plate may also have a horizontal component and/or may include an inclination towards the front or rear if deemed appropriate.

As an alternative to the round drive belts 33, flat belts can be provided with functions similar to those of round belts, as well as instead of pneumatic actuators for moving the accumulation plane 34 and/or for the arrest control device 69, electromagnetic actuators with similar functions can be provided.

The lifting members 156 for the accumulation of the shorter sheets can be replaced by thrust pulleys for the lower branches 43 of the driving belts 33. The thrust pulleys lead the branches 43 to slide on the plane 34 or contact corresponding counter-pressure rollers near the input gate 26 for an early engagement between the driving belts 33 and the entering sheets 20.

We claim:

1. A sheet accumulating equipment comprising an accumulation plane for sheets entering along a feeding direction, a plurality of driving belts of elongated shape, with respective lower branches positioned in parallel a little above the accumulation plane and ramp members arranged along the path of the sheets and lifting the sheets with engagement with said lower branches and wherein said belts are driven for dragging the lifted sheets with the lower branches and depositing the sheets, by jump, on the accumulation plane or on sheets in accumulation, said accumulating equipment further comprising a suspension group for the accumulation plane, a shifting command mechanism and a carriage of support for said ramp members, wherein said suspension group is provided for allowing a vertical shifting of the accumulation plane with respect to the ramp members so as to modify the height of the jump, and said shifting command mechanism can be actuated for the vertical shifting of the accumulation plane by adapting the height of the jump according to number and thickness of the accumulated sheets, said accumulation plane defines a plurality of longitudinal slots, while the ramp members are mounted on said carriage and are partially housed in said longitudinal slots; and wherein said carriage is longitudinally shiftable for limiting, by means of the ramp members, a longitudinal extension of a sheet gathering area functionally to the length of the sheets to be accumulated.

2. Sheet accumulating equipment according to claim 1, wherein the suspension group has an articulated quadrilateral structure of connection between the accumulation plane and a frame of the equipment, said quadrilateral structure comprises four lever arms pivoted between the frame and respective end portions of the accumulation plane and wherein said accumulation plane is shiftable by rotations of said lever arms.

3. Sheet accumulating equipment according to claim 2, wherein said shifting command mechanism comprises four pneumatic actuators and adjusting screws, said pneumatic actuators are operative on the lever arms for two different heights of the jump through the adjustment screws and wherein said adjustment screws can be manually operated to define a reference position of the accumulation plane.

4. Sheet accumulating equipment according to claim 1, wherein said shifting command mechanism comprises one or more micro-motors for the vertical shifting of the accumulation plane in accordance with number and thickness of the accumulated sheets so as to optimize the jump of said sheets.

5. Sheet accumulating equipment according to claim 1, wherein the ramp members define grooves for accommodating the driving belts, while said belts are tensioned between input grooved pulleys and output grooved pulleys upstream and downstream of the accumulation plane and passage through the grooves of the ramp members, said driving belts are operative for dragging the entering sheets jointly to engagement with the ramp members, and wherein said equipment further comprises lifting members associated individually to the driving belts, said lifting members are arranged between the ramp members and the input grooved pulleys, and wherein the lifting members have a groove housing the lower branches of the belts and are provided for causing said lower branches to engage and drag the entering sheets before the engagement of said sheets with the ramp members.

6. Accumulation equipment according to claim 1, further comprising two racks fixedly mounted on sides of the accumulation plane, two slides, connected with the carriage of support for said ramp members and slidably mounted on said racks and two pinions rotatably supported by the slides and meshed with the racks for shifting the support carriage by means of said slides in response to rotation of said pinions.

7. Accumulation equipment according to claim 6, further comprising a frame of support for the accumulation plane, wherein said frame includes longitudinal beams and transversal beams, said accumulation plane is fixed on said transversal beams so as to leave two free spaces between the sides of the accumulation plane and the longitudinal beams, and wherein said carriage is connected with the two slides by means of corresponding lugs passing through said free spaces.

8. Sheet accumulating equipment according to claim 1 further comprising a sheet arrest group with a bank member and an arrest control device, wherein said arrest control device is provided for actuating the sheet arrest group between a closed disposition in which the bank member arrests leading edges of sheets in accumulation and an open disposition in which the bank member allows an outgoing passage of the accumulated sheets.

9. Sheet accumulating equipment according to claim 8 further comprising a forwarding mechanism which includes a pair of output rollers and a forward actuation device, wherein said output rollers are arranged upstream and close to the bank member in overlapping condition, respectively above and below the accumulation plane, while the forward actuation device is provided for positioning the output rollers between an accumulation arrangement and a forwarding arrangement, said rollers are separated by a separation space and allow the accumulation of the sheets in the accumulation arrangement and the closed disposition of the bank member, while engage the accumulated sheets in the forwarding arrangement and the open disposition of the bank member and in which said output rollers are driven in synchronism and opposite sense of rotation for output forwarding the accumulated sheets in said forwarding arrangement.

10. Sheet accumulating equipment according to claim 8 further comprising a platform, arranged downstream of the accumulation plane, wherein said platform is of partial support for the sheets in accumulation and defines a series of transversal openings, the bank member includes a series of arrest lugs aligned transversely to the feed direction of the sheets, and wherein said lugs, in the closed disposition of the sheet arrest group, are projecting upwardly from the platform through said transversal openings for arresting the sheets in accumulation and are below the platform in the open disposition of the sheet arrest group for a free passage of the accumulated sheets.

11. Sheet accumulating equipment according to claim 1, wherein said equipment is used in association with a cutter machine at the input and with a folder machine at the output for 2 to 30 sheets to be accumulated, and in which each sheet has a width of about 20 to 50 cm and a length of about 20 to 70 cm, while the jump has a height of about 7 to 10 mm between the top of the ramp members and a geometric plane tangent to the lower branches of the driving belts.

* * * * *